US007234975B2

(12) United States Patent
Abe

(10) Patent No.: US 7,234,975 B2
(45) Date of Patent: Jun. 26, 2007

(54) VEHICLE POWER SUPPLY OUTLET

(75) Inventor: Kenichi Abe, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 11/481,269

(22) Filed: Jul. 5, 2006

(65) Prior Publication Data

US 2007/0010136 A1 Jan. 11, 2007

(30) Foreign Application Priority Data

Jul. 5, 2005 (JP) ..... 2005-196464

(51) Int. Cl.
*H01R 24/04* (2006.01)

(52) U.S. Cl. ..... 439/668; 439/474

(58) Field of Classification Search ..... 439/668–669, 439/474

See application file for complete search history.

(56) References Cited

U.S. PATENT DOCUMENTS 4,109,988 A * 8/1978 Olson ..... 439/265
5,326,283 A * 7/1994 Chen ..... 439/620.34
6,855,003 B1 * 2/2005 Wyant ..... 439/502
6,902,436 B2 * 6/2005 Liao ..... 439/668

FOREIGN PATENT DOCUMENTS

JP 2004-036995 2/2004

* cited by examiner

*Primary Examiner*—Truc Nguyen
(74) *Attorney, Agent, or Firm*—Patterson, Thuente, Skaar & Christensen, P.A.

(57) ABSTRACT

A vehicle power supply outlet connectable to a car cigarette lighter and to an electrical device plug. The power supply outlet includes a cylindrical socket including an engagement plate for engaging the cigarette lighter or the electrical device plug that is inserted into the socket. The engagement plate includes a hook elastically deformable in a radially outward direction of the socket. A sleeve including a recess is fitted to the socket. The recess receives the hook of the engagement plate when the hook is elastically deformed in the radially outward direction. Deformation of the hook is restricted by contact between the hook and the bottom surface of the recess. This prevents permanent deformation of the hook.

11 Claims, 4 Drawing Sheets

VEHICLE POWER SUPPLY OUTLET

BACKGROUND OF THE INVENTION

The present invention relates to a vehicle power supply outlet for receiving, for example, a car cigarette lighter and an electrical device plug.

In the prior art, a vehicle power supply outlet is used to receive a car cigarette lighter. The power supply outlet includes a socket into which the cigarette lighter is inserted. The socket is cylindrical and has a closed bottom surface. Further, the socket is accommodated in a cylindrical case, which is arranged in the instrument panel of a vehicle. A U-shaped bimetal contact is fixed to the inner bottom surface of the socket.

The cigarette lighter includes a handle, which is held by a person's hand, and a lighter main body, which supports the handle. The lighter main body includes an outer body, an inner body, a spring, and a heating element. The outer body and the inner body are cylindrical. A spring is arranged between the outer body and the inner body. When the cigarette lighter is inserted into the socket, the outer body is fixed relative to the socket, and the inner body is movable relative to the outer body from a predetermined position. The spring constantly urges the inner body in a direction in which the inner body returns to its original position, or the predetermined position. The handle is pushed to compress the spring so that the heating element projects from the distal end of the cigarette lighter.

The socket has a circumferential wall. A slot extends through the circumferential wall in the insertion direction of the cigarette lighter. An elastic engagement plate extends through the slot. When the cigarette lighter is inserted into the socket, the cigarette lighter engages and elastically deforms the engagement plate in a radially outward direction of the socket. When the cigarette lighter is completely inserted into the socket, the engagement plate restores its original shape and engages an engagement portion formed in the outer body of the cigarette lighter. In this state, the cigarette lighter is arranged at a position where the cigarette lighter is normally held in the power supply outlet, or a normal position.

To use the vehicle power supply outlet, the handle of the cigarette lighter is pushed in with the cigarette lighter held at the normal position by the engagement plate of the socket. In this state, the outer body of the cigarette lighter is supported in a fixed state by the socket. Thus, only the inner body moves inward as it compresses the spring. This engages the heating element of the cigarette lighter with the bimetal contact. As a result, current flows through and heats the heating element. As the temperature of the heating element increases, the bimetal contact deforms away from the socket. This disengages the heating element from the bimetal. Further, the force of the spring causes the inner body to return to its original position together with the handle. In this state, the outer body of the cigarette lighter is held and supported by the engagement plate of the socket. Thus, the inner body is supported in a state in which the cigarette lighter is arranged at the normal position. The cigarette lighter, in which the heating element has been heated, is then removed from the socket to, for example, light a cigarette (refer to Japanese Laid-Open Patent Publication No. 2004-36995).

In recent years, proposals have been made to use the vehicle power supply outlet to power electrical devices in addition to heating cigarette lighters. For example, a vehicle power supply outlet may be used to power a car navigation system or to charge the battery of a cellular phone. Such an electrical device is provided with a plug, which is inserted into the vehicle power supply outlet. The plug includes a negative terminal, which is urged radially outward to be extensible from the plug, and a positive terminal, which is arranged on the distal end of the plug. When the negative terminal contacts the inner surface of the socket and the positive terminal contacts the inner bottom surface of the socket, power is supplied from the vehicle battery to the electrical device via the plug.

However, the socket has an inner diameter that differs between manufacturers. Thus, the extensible negative terminal of the electrical device plug extends radially outward from the plug in accordance with the inner diameter of the socket. This makes the plug applicable to socket bodies of different inner diameters. Further, the negative terminal of such a plug must contact the inner surface of the socket with a certain level of pressure. Thus, the negative terminal is urged radially outward from the socket by a relatively strong force. However, when the negative terminal engages the engagement plate of the socket, the strong urging force of the negative terminal may deform the engagement plate beyond its elastic deformation limit and permanently bend the engagement plate. If the engagement plate is deformed in such a manner, the next time the cigarette lighter is inserted into the socket, the socket may not be capable of firmly holding the cigarette lighter.

SUMMARY OF THE INVENTION

The present invention provides a vehicle power supply outlet that prevents the engagement plate from being permanently deformed when an electrical device plug is connected to the power supply outlet.

One aspect of the present invention is a vehicle power supply outlet for receiving a car cigarette lighter and an electrical device plug in lieu of the cigarette lighter. The power supply outlet includes a cylindrical socket into which the cigarette lighter and the electrical device plug are each insertable. An engagement plate, arranged in the socket, engages the cigarette lighter or the electrical device plug when inserted into the socket. The engagement plate is elastically deformable in a radially outward direction of the socket. An elastic deformation restriction member faces towards the engaging plate outside the socket. The elastic deformation restriction member contacts and restricts deformation of the engagement plate when the engagement plate is elastically deformed in the radially outward direction.

A further aspect of the present invention is a vehicle power supply outlet for receiving a car cigarette. lighter and an electrical device plug in lieu of the cigarette lighter. The power supply outlet includes a cylindrical socket into which the cigarette lighter and the electrical device plug are each insertable. An engagement plate, arranged in the socket and extending in an axial direction of the socket, engages the cigarette lighter or the electrical device plug when inserted into the socket. The engagement plate includes a hook elastically deformable in a. radially outward direction of the socket. A sleeve is fitted to the socket. The sleeve includes a recess, having a bottom surface, for receiving the hook of the engagement plate when the hook is elastically deformed in the radially outward direction. The recess enables elastic deformation of the hook for a predetermined amount and restricts further elastic deformation of the hook when the hook contacts the bottom surface of the recess. The recess has a predetermined depth determined so as to prevent permanent deformation of the hook.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3 is a cross-sectional view of the vehicle power supply outlet when the cigarette lighter is pushed in;

DETAILED DESCRIPTION OF THE PREFERRED EMBODIMENTS

A vehicle power supply outlet 1 according to a preferred embodiment of the present invention will now be described with reference to FIGS. 1 to 5.

Figure 1:
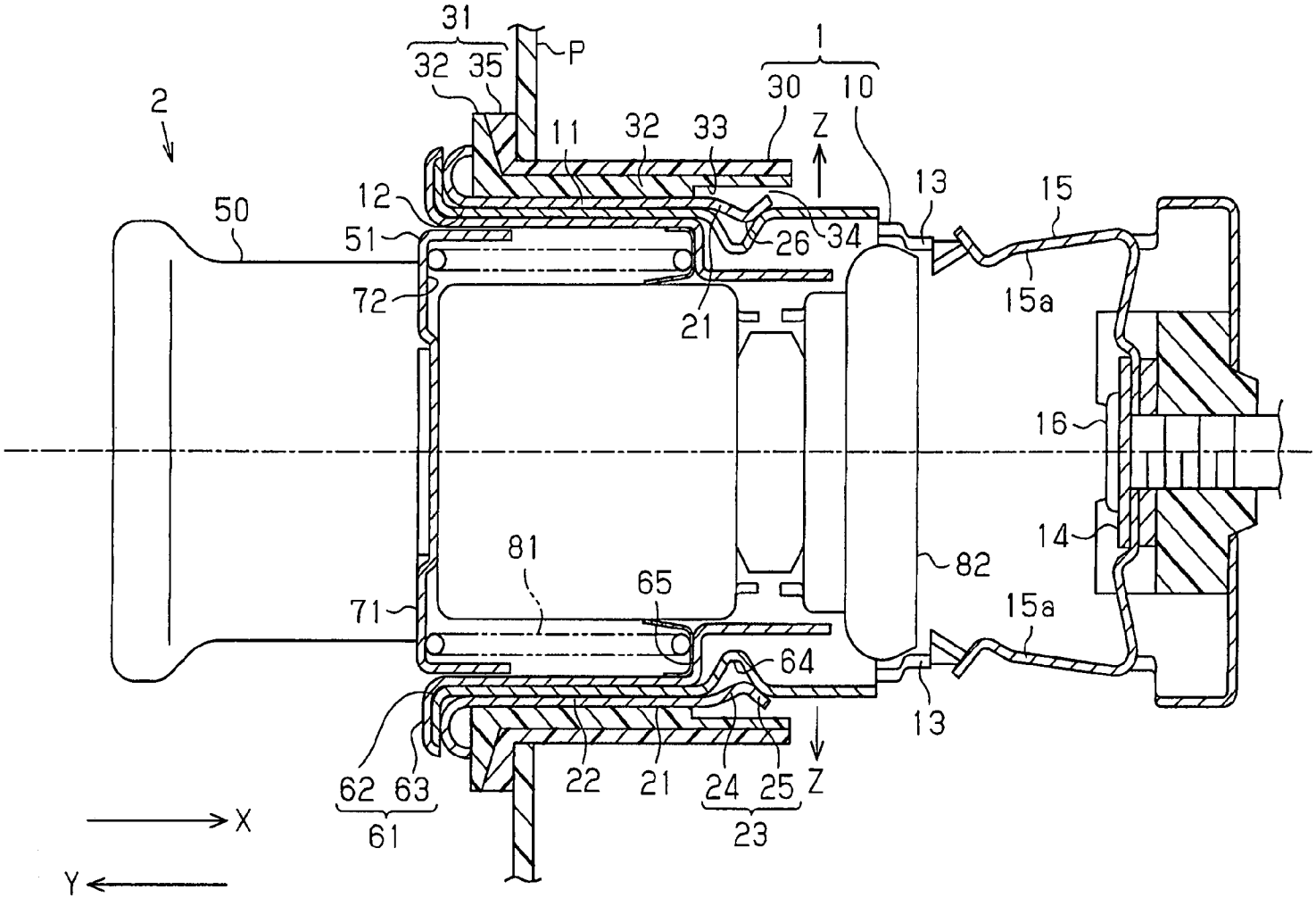
FIG. 1 is a cross-sectional view of a vehicle power supply outlet according to a preferred embodiment of the present invention.

Referring to FIG. 1, the vehicle power supply outlet 1 includes a socket 10, into which a cigarette lighter 2 is inserted, and a lighting mechanism 30, which lights the surrounding of the cigarette lighter 2.

The cigarette lighter 2 includes a handle 50, which is held by a person's hand, and a lighter main body 51, which supports the handle. The lighter main body 51 includes an outer body 61, an inner body 71, a spring 81, and a heating element 82. The inner body 71 is accommodated in the outer body 61. Further, referring to FIG. 1, the inner body 71 is movable relative to the outer body 61 in a pushing direction, which is indicated by arrow X, and a returning direction, which is indicated by arrow Y. The outer body 61 includes a first outer body piece 62, which directly contacts the inner surface of the socket 10, and a second outer body piece 63, which supports the internal mechanism of the cigarette lighter 2. The first outer body piece 62 includes a narrowed portion 64, which is formed by narrowing the vicinity of the distal end and which extends continuously in the circumferential direction. The narrowed portion 64 functions as an engagement portion. The first outer body piece 62 and the second outer body piece 63 are in close contact with each other from the basal end (left end as viewed in FIG. 1) to the narrowed portion 64. The portion of the second outer body piece 63 corresponding to the narrowed portion 64 of the first outer body piece 62 has a reduced diameter so that the narrowed portion 64 can extend radially inward. The basal side of the reduced diameter portion defines a seat 65, which is formed by inwardly bending the first outer body piece 62 at a right angle. The spring 81 is arranged between the second outer body piece 63 and the inner body 71. More specifically, the spring 81 is supported between the seat 65 of the second outer body piece 63 and an inner basal surface 72 of the inner body 71 in a compressible manner.

The heating element 82 is arranged on the distal end of the inner body 71 so as to move integrally with the inner body 71. The heating element 82 is heated when supplied with current. When the cigarette lighter 2 is inserted into the socket 10, the outer body 61 is supported by the socket 10 in a manner that movement of the outer body 61 is restricted while movement of the inner body 71 is enabled. The spring 81 urges the inner basal surface 72 in the returning direction, which is indicated by arrow Y in FIG. 1. Thus, the inner body 71 and the handle 50 are urged in the returning direction. When the handle 50 is pushed in the pushing direction, which is indicated by arrow X in FIG. 1, the inner basal surface 72 of the inner body 71 moves and compresses the spring 81. The heating element 82 is moved together with the inner body 71 in the pushing direction. When the inner body 71 is moved in the returning direction, which is indicated by arrow Y in FIG. 1, a stopper (not shown) restricts movement of the inner body.

The socket 10 is partially exposed from the instrument panel P and has an opening 12 that opens in the front side of the instrument panel P. Further, the socket 10 includes a socket body 11, which is cylindrical and has a closed bottom end. The cigarette lighter 2 is inserted into the socket 10 from the opening 12. The socket body 11 has a side wall including two slots 13 located at opposing positions. Each slot 13 is elongated and extends in the insertion direction of the cigarette lighter 2. An engagement plate 21, which extends in the insertion direction, is arranged in each slot 13. Each engagement plate 21 is formed continuously with the side wall of the socket body 11.

Each engagement plate 21 includes a basal portion 22 and a hook 23. The basal portion 22 extends parallel to the pushing direction as indicated by arrow X and the returning direction as indicated by arrow Y in FIG. 1. The hook 23 is formed on the distal end of each engagement plate 21 and is V-shaped so as to extend in a radially inward direction of the socket 10. The hook 23 includes a first hook portion 24, a second hook portion 25, and a bent portion 26. The first hook portion 24 is connected with the basal portion 22 and extends in a radially inward direction of the socket 10 toward the distal end of the engagement plate 21. The second hook portion 25 extends in a radially outward direction of the socket 10 toward the distal end of the engagement plate 21. The bent portion 26 continuously connects the first and second hook portions 24 and 25. When the cigarette lighter 2 is inserted into the socket 10, the first outer body piece 62 of the cigarette lighter 2 contacts and moves along the engagement plate 21. This elastically deforms the engagement plate 21 in the radially outward direction of the socket 10. Further, the bent portion 26 of the engagement plate 21 engages the narrowed portion 64 of the cigarette lighter 2 to prevent accidental removal of the cigarette lighter 2 from the socket 10. In a state in which the engagement plate 21 is engaged with the narrowed portion 64 of the cigarette lighter 2, the cigarette lighter 2 is located at a predetermined normal position where it is normally held in the vehicle power supply outlet 1.

The socket body 11 has an inner bottom surface 14 on which a U-shaped bimetal contact 15 is arranged. The bimetal contact 15 is fixed to the socket body 11 by a bolt 16 so that its open side faces toward the opening 12. More specifically, the bimetal contact 15 is bent so that two engagement terminals 15*a* extend in the axial direction of the socket body 11. When the handle 50 of the cigarette lighter 2 is pushed in, the engagement terminals 15*a* engage the sides of the heating element 82. This supplies current to the heating element 82 and heats the heating element 82.

When the heating element 82 reaches a predetermined temperature, the engagement terminals 15*a* are deformed in a radially outward direction of the socket body 11 as indicated by arrow Z in FIG. 1. This disengages the engagement terminals 15*a* from the sides of the heating element 82. As a result, the force of the spring 81 moves the handle 50 and the inner body 71 of the cigarette lighter 2 in the returning direction as indicated by arrow Y in FIG. 1 such that the inner body 71 pops out in the opening in the outer body 61. Although the force of the spring 81 causes the inner body 71 and the handle 50 to pop out, the narrowed portion 64 of the outer body 61 is engaged with the socket 10 due to the elastic force of the engagement plates 21. Thus, the cigarette lighter 2 does not fall out of the socket 10. In this state, the cigarette lighter 2 may be removed from the socket 10 to, for example, light a cigarette.

Figure 4:
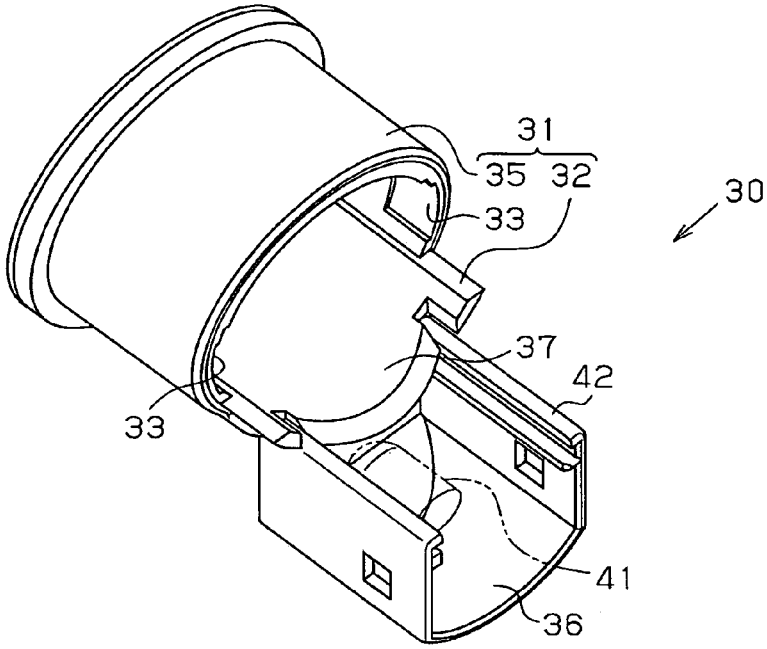
FIG. 4 is a perspective view showing a light source mechanism.

Referring to FIGS. 1 and 4, the lighting mechanism 30 is arranged at the outer side of the socket 10. The lighting mechanism 30 includes a lighting ring 31, a light source 41, and a light source support 42.

The lighting ring 31 includes a first sleeve 32 and a second sleeve 35. The first sleeve 32, which is made of a transparent synthetic resin, is cylindrical and has open ends. Further, the first sleeve 32 is arranged so as to cover at least the outer sides of the engagement plates 21 of the socket 10. The second sleeve 35 is arranged so as to cover the outer circumference of the first sleeve 32 and is made of an opaque synthetic resin.

The first sleeve 32 has an inner surface including two recesses 33. The inner surface of the first sleeve 32, except for the recesses 33, is in contact with the outer body 61 of the socket 10. The recesses 33 are formed to face toward the distal ends of the engagement plates 21, or more specifically, the hooks 23 of the engagement plates 21. A gap 34 is formed between the bottom surface of each recess 33 and the corresponding engagement plate 21. When the cigarette lighter 2 is inserted into the socket 10, the gap 34 enables the corresponding engagement plate 21 to be elastically deformed in the radially outward direction as indicated by arrow Z in FIG. 1. The recess 33 has a depth (the gap 34) that is set such as to restrict deformation of the engagement plate 21 that exceeds the elastic deformation limit of the engagement plate 21 when the engagement plate 21 contacts the bottom surface of the recess 33. That is, the distal end of the second hook portion 25 in the engagement plate 21 contacts the bottom wall of the recess 33 in the first sleeve 32 before the engagement plate 21 becomes permanently deformed. Thus, the engagement plates 21 do not deform beyond their elastic deformation limits.

As shown in FIG. 4, the light source support 42, which is U-shaped, extends from the distal end of the second sleeve 35. The open upper end of the light source support 42, as viewed in FIG. 4, is flush with the inner surface of the second sleeve 35. The light source support 42 axially extends from the second sleeve 35. The light source 41 (diode in the preferred embodiment) is arranged in the light source support 42. Further, an arcuate wall 37 extends from the distal end of the second sleeve 35. When the light source 41 in the light source support 42 emits light, the light passes through the arcuate wall 37 and propagates in the first sleeve 32. Then, the light is emitted out of the first sleeve 32. The emitted light illuminates the surrounding of the cigarette lighter 2 on the instrument panel P. Therefore, in a dark state, such as during nighttime or when driving the vehicle in a tunnel, the driver may easily recognize the positions of the cigarette lighter 2 and the socket 10.

Instead of the cigarette lighter 2, an electrical device plug 3 may be connected to the vehicle power supply outlet 1. The electrical device plug 3 is connected to the distal end of an electric cord 39 extending from an electrical device, such as a commercially available car navigation system or a battery charger for a cellular phone. The connection of the electrical device plug 3 to the socket 10 enables the electrical device to be supplied with power from the car battery.

The electrical device plug 3 includes a cylindrical plug body 90. Negative terminals 91 extend out of the electrical device plug 3. The negative terminals 91 are urged radially outward in an extensible manner from the plug body 90.

The plug body 90 includes a handle 92, which is made of an insulative resin material, and a positive terminal 93, which extends from the center of the distal end of the handle 92. The positive terminal 93 is tapered and made of a conductive metal. When the electrical device plug 3 is inserted into the socket 10, the positive terminal 93 contacts the inner bottom surface 14 of the socket body 11. The negative terminals 91 are located at two locations in the side wall of the plug body 90. When the electrical device plug 3 is inserted into the socket 10, the negative terminals 91 contact the inner surface of the socket body 11. In this state, the negative terminals 91 are constantly urged toward the inner surface of the socket body 11 in the radially outward direction. Thus, the negative terminals 91 contact the inner surface of the socket body 11, and the positive terminal 93 contacts the inner bottom surface 14 of the socket body 11. This supplies the electrical device with power from the car battery via the electrical device plug 3.

The operation of the vehicle power supply outlet 1 will now be discussed.

Figure 2:
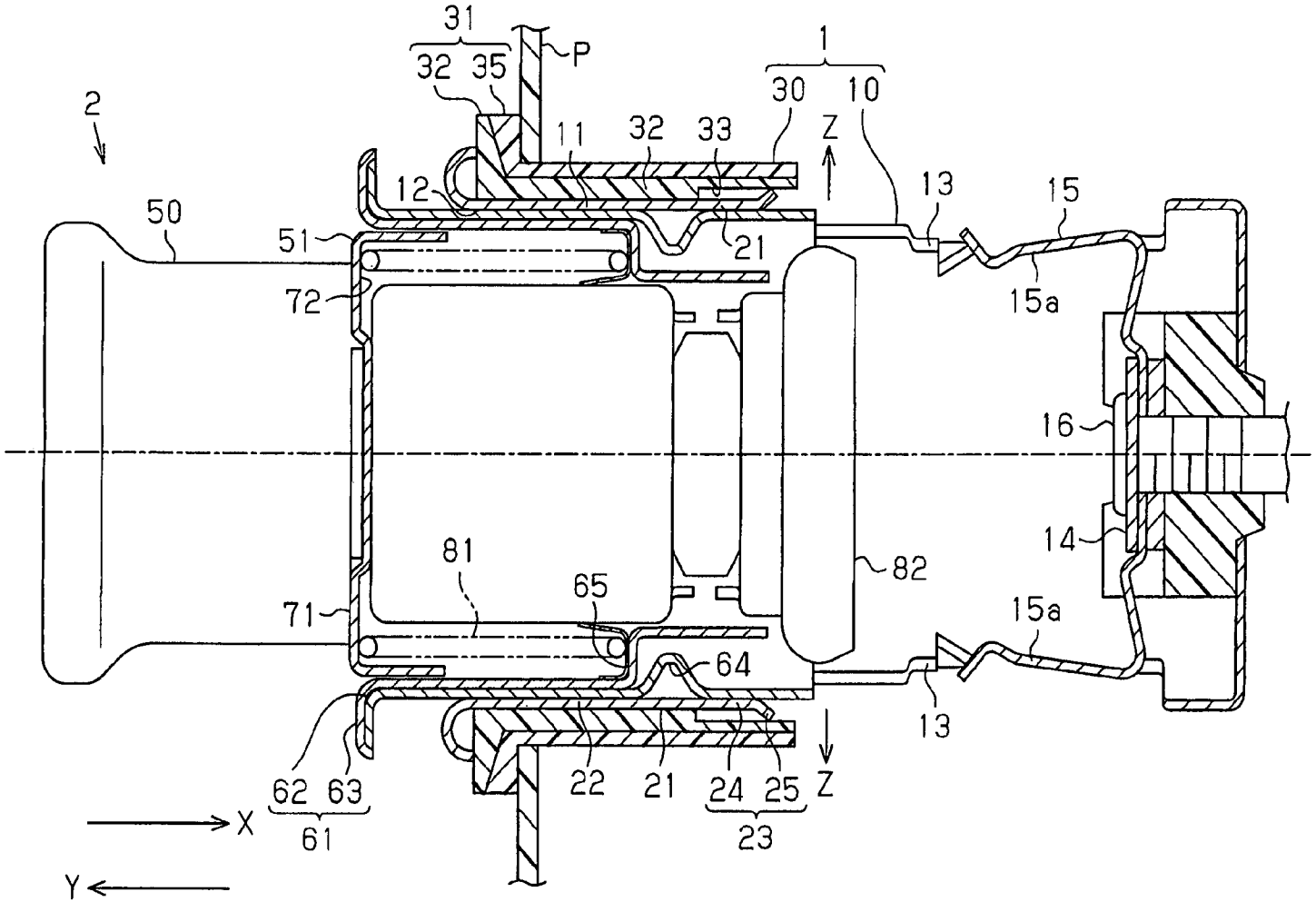
FIG. 2 is a cross-sectional view of the vehicle power supply outlet when receiving a cigarette lighter.

First, the insertion of the cigarette lighter 2 into the socket 10 will be described. In a state in which the vehicle power supply outlet 1 is empty, the cigarette lighter 2 is inserted into the socket 10. Referring to FIG. 2, the outer body 61 of the cigarette lighter 2 moves along the inner surface of the socket body 11 in the pushing direction indicated by arrow X. The second outer body piece 63 of the lighter main body 51 urges the bent portion 26 of each engagement plate 21 in the radially outward direction as the cigarette lighter 2 moves in the direction indicated by arrow X. This elastically deforms and moves the distal end of the engagement plate 21 in the direction indicated by arrow Z in FIG. 2. The maximum deformation of the engagement plate 21 is determined by the gap 34 formed by the corresponding recess 33 in the first sleeve 32 of the lighting ring 31. Thus, the engagement plate 21 is not deformed beyond its elastic deformation limit and is this not permanently deformed.

Referring to FIG. 1, the cigarette lighter 2 is further advanced in the pushing direction indicated by arrow X. When the narrowed portion 64 of the lighter main body 51 reaches the bent portion 26 of each engagement plate 21, the bent portion 26 returns to its original shape in the narrowed portion 64. This hooks the lighter main body 51 to the engagement plates 21 and restricts movement of the second outer body piece 63 of the cigarette lighter 2 in the returning direction indicated by arrow Y.

Figure 3:
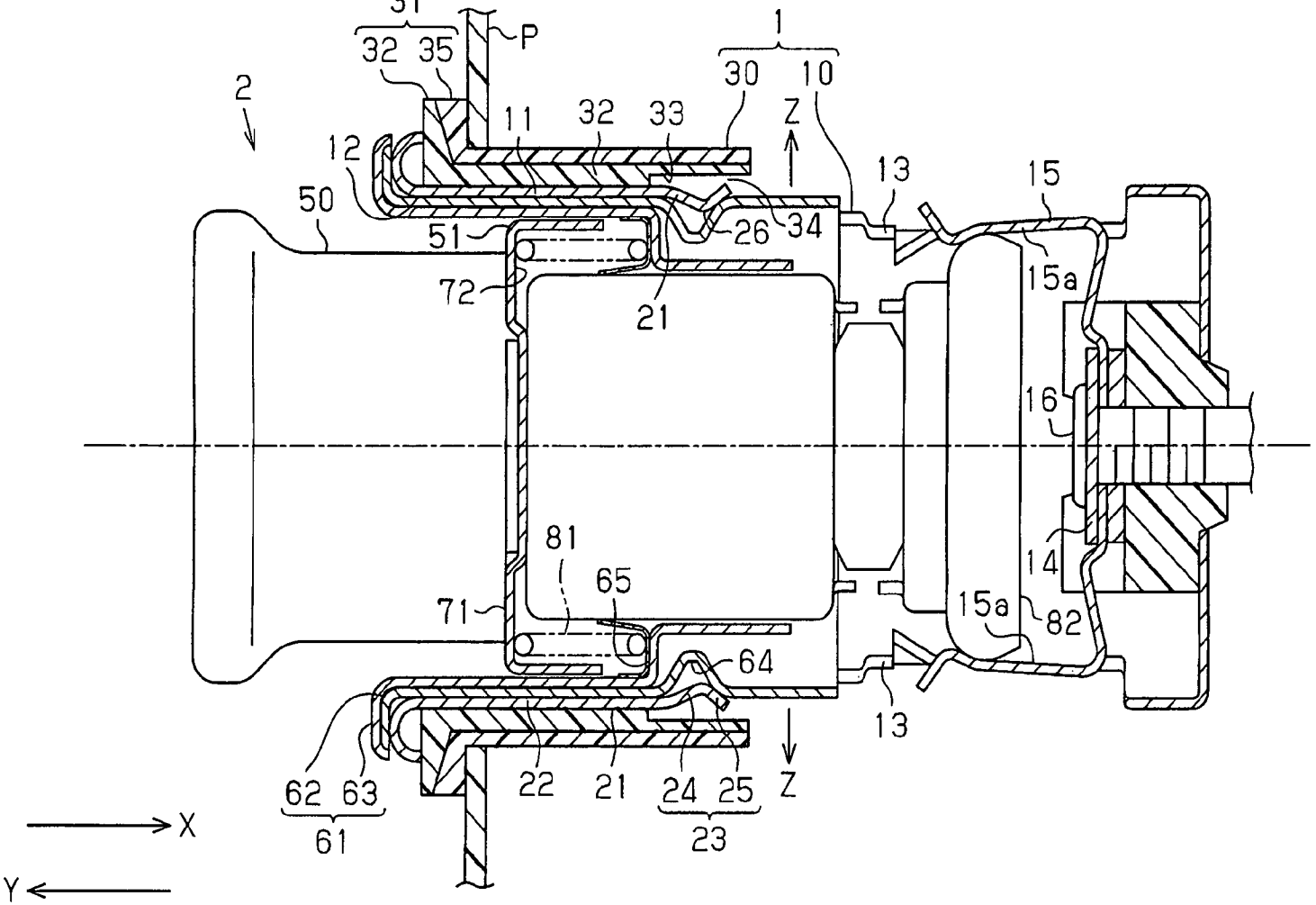

To light a cigarette when the cigarette lighter 2 is inserted into the vehicle power supply outlet 1, a vehicle occupant pushes the handle 50 of the lighter main body 51 against the force of the spring 81. Referring to FIG. 3, this hooks the heating element 82, which is arranged on the distal end of the inner body 71, to the bimetal contact 15 of the socket 10. As a result, the heating element 82 is electrically connected to the bimetal contact 15 and supplied with current such that the heating element 82 is heated. When the heating element 82 reaches a predetermined temperature, the engagement terminals 15*a* of the bimetal contact 15 are deformed in the outward direction as indicated by arrow Z. This disengages the heating element 82 from the bimetal contact 15. As a result, the force of the spring 81 pops the inner body 71 of the lighter main body 51 out in the opening of the outer body 61 thereby returning the cigarette lighter 2 to its normal position, which is shown in the state of FIG. 1. In this state, the narrowed portion 64 of the outer body 61 is engaged with the engagement plates 21 of the socket 10. Thus, even if the force of the spring 81 causes the inner body 71 and the handle 50 to pop out, the cigarette lighter 2 is prevented from falling out of the socket 10.

Figure 5:
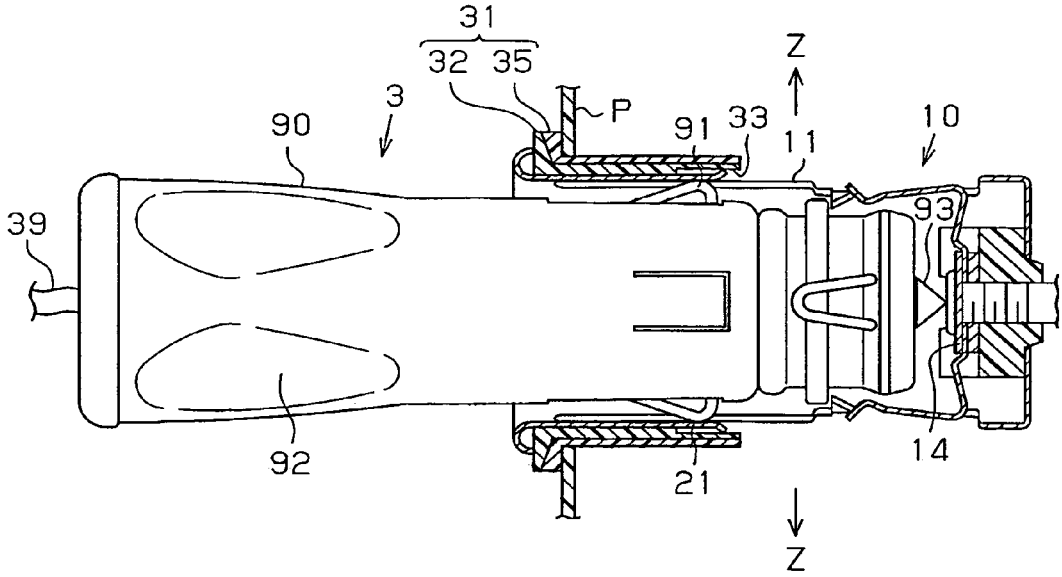
FIG. 5 is a cross-sectional view of the vehicle power supply outlet when receiving an electrical device plug.

When connecting the electrical device plug 3 to the vehicle power supply outlet 1, referring to FIG. 5, the electrical device plug 3 is inserted into the socket 10. This presses the negative terminals 91 of the electrical device plug 3 in the radially inward direction of the plug body 90. As the electrical device plug 3 moves in the pushing direction indicated by arrow X, the negative terminals 91 move along the inner surface of the socket body 11 while urging the inner surface of the socket body 11 in the outward direction indicated by arrow Z. In this state, the elastic force of the engagement plates 21 in the socket body 11 support the outer surface of the plug body 90. Further movement of the electrical device plug 3 in the pushing direction causes the positive terminal 93 to contact the inner bottom surface 14 of the socket body 11. In this state, the electrical device plug 3 enables power to be supplied from the car battery to the electrical device.

When connecting the electrical device plug 3 to the socket 10, the negative terminals 91 of the electrical device plug 3 may coincidentally contact the engagement plates 21 of the socket body 11. In such a case, a strong urging force in the outward direction as indicated by arrow Z would be applied to the engagement plates 21. This would elastically deform the engagement plates 21 by a large amount. However, such deformation is restricted when the distal end of each engagement plate 21 abuts against the bottom surface of the corresponding recess 33 in the first sleeve 32. Thus, during usage of the electrical device, the engagement plates 21 are not deformed beyond their elastic deformation limit. This prevents each engagement plate 21 from being permanently bent. Accordingly, when the electrical device plug 3 is removed from the vehicle power supply outlet 1 and the cigarette lighter 2 is inserted into the power supply outlet 1, the engagement plates 21 support and hold the cigarette lighter 2 at the normal position.

The vehicle power supply outlet 1 of the preferred embodiment has the advantages described below.

(1) When inserting the electrical device plug 3 into the socket 10, the engagement plates 21 are deformed in the radially outward direction of the socket 10. However, in this case, each engagement plate 21 abuts against the bottom surface of the corresponding recess 33 in the first sleeve 32 of the lighting ring 31. This restricts deformation of the engagement plate 21 beyond its elastic deformation limit. Accordingly, when inserting the electrical device plug 3 into the socket 10, deformation of the engagement plates 21, which are used to engage and hold the cigarette lighter 2, is suppressed. This prevents the holding force of the engagement plates 21, which holds the cigarette lighter 2, from decreasing when the cigarette lighter 2 is re-inserted into the socket 10 after use of the electrical device plug 3.

(2) The first sleeve 32 including the recesses 33 are arranged in the cylindrical lighting ring 31. Thus, the gaps 34 are easily formed by fitting the lighting ring 31 to the socket 10. This prevents permanent deformation of the engagement plates.

(3) The recesses 33 are formed in the first sleeve 32. Thus, when the vehicle power supply outlet 1 incorporates the lighting mechanism 30, permanent deformation of the engagement plates 21 is prevented without increasing the number of components.

It should be apparent to those skilled in the art that the present invention may be embodied in many other specific forms without departing from the spirit or scope of the invention. Particularly, it should be understood that the present invention may be embodied in the following forms.

In the above embodiment, the first sleeve 32 of the lighting ring 31 that restricts deformation of the engagement plates 21 is cylindrical. However, the deformation of the first engagement plates 21 does not have to be restricted by such a cylindrical deformation restriction member. The deformation restriction member may have any shape as long as it restricts deformation of the engagement plates 21 at the outer side of the engagement plates 21. Such a structure would have the above advantages (1) and (2).

In the above embodiment, the first sleeve 32 of the lighting ring 31 is used as the deformation restriction member. Alternatively, when the vehicle power supply outlet 1 does not incorporate the lighting mechanism 30, a cylindrical restriction member may be fitted to the socket 10. Such a structure would have the above described advantage (1).

The first sleeve 32 and the second sleeve 35 of the lighting ring 31 may be formed integrally with each other.

The present examples and embodiments are to be considered as illustrative and not restrictive, and the invention is not to be limited to the details given herein, but may be modified within the scope and equivalence of the appended claims.

What is claimed is:

1. A vehicle power supply outlet for receiving a car cigarette lighter and an electrical device plug in lieu of the cigarette lighter, the power supply outlet comprising:

a cylindrical socket into which the cigarette lighter and the electrical device plug are each insertable;

an engagement plate, arranged in the socket, for engaging the cigarette lighter or the electrical device plug when inserted into the socket, wherein the engagement plate is elastically deformable in a radially outward direction of the socket; and an elastic deformation restriction member facing towards the engaging plate outside the socket, wherein the elastic deformation restriction member contacts and restricts deformation of the engagement plate when the engagement plate is elastically deformed in the radially outward direction.

2. The vehicle power supply outlet according to claim 1, further comprising:

a sleeve fitted to the socket, wherein the sleeve forms the elastic deformation restriction member and includes a recess, having a bottom surface, for receiving the engagement plate when the engagement plate is elastically deformed in the radially outward direction, the recess enabling elastic deformation of the engagement plate for a predetermined amount and restricting further elastic deformation of the engagement plate when the engagement plate contacts the bottom surface of the recess.

3. The vehicle power supply outlet according to claim 2, wherein the recess has a predetermined depth determined so as to prevent permanent deformation of the engagement plate.

4. The vehicle power supply outlet according to claim 1, further comprising:

a lighting mechanism for lighting the surrounding of the socket, with the lighting mechanism including a first sleeve fitted to the socket, wherein the first sleeve forms the elastic deformation restriction member and includes a recess, having a bottom surface, for receiving the engagement plate when the engagement plate is elastically deformed in the radially outward direction, the recess enabling elastic deformation of the engagement plate for a predetermined amount and restricting further elastic deformation of the engagement plate when the engagement plate contacts the bottom surface of the recess.

5. The vehicle power supply outlet according to claim 4, wherein the lighting mechanism further includes:

a second sleeve fitted to the first sleeve;

a light source support extending from the second sleeve; and a light source supported by the light source support.

6. The vehicle power supply outlet according to claim 1, wherein the engagement plate includes an elastically deformable hook for engaging the cigarette lighter when the cigarette lighter is inserted into the socket and holding the cigarette lighter at a predetermined position.

7. The vehicle power supply outlet according to claim 6, further comprising:

a sleeve fitted to the socket, wherein the sleeve forms the elastic deformation restriction member and includes a recess, having a bottom surface, for receiving the hook of the engagement plate when the hook is elastically deformed in the radially outward direction, the recess enabling elastic deformation of the hook for a predetermined amount and restricting further elastic deformation of the hook when the hook contacts the bottom surface of the recess.

8. The vehicle power supply outlet according to claim 7, wherein the recess has a predetermined depth determined so as to prevent permanent deformation of the hook.

9. The vehicle power supply outlet according to claim 1, wherein the socket includes a slot extending in an axial direction of the socket, and the engagement plate is arranged in the slot.

10. A vehicle power supply outlet for receiving a car cigarette lighter and an electrical device plug in lieu of the cigarette lighter, the power supply outlet comprising:

a cylindrical socket into which the cigarette lighter and the electrical device plug are each insertable;

an engagement plate, arranged in the socket and extending in an axial direction of the socket, for engaging the cigarette lighter or the electrical device plug when inserted into the socket, wherein the engagement plate includes a hook elastically deformable in a radially outward direction of the socket; and a sleeve fitted to the socket, wherein the sleeve includes a recess, having a bottom surface, for receiving the hook of the engagement plate when the hook is elastically deformed in the radially outward direction, the recess enabling elastic deformation of the hook for a predetermined amount and restricting further elastic deformation of the hook when the hook contacts the bottom surface of the recess, and the recess having a predetermined depth determined so as to prevent permanent deformation of the hook.

11. The vehicle power supply outlet according to claim 10, wherein the sleeve forms part of a lighting mechanism for lighting the surrounding of the socket.

* * * * *